United States Patent [19]

Zwicker

[11] 4,409,002

[45] Oct. 11, 1983

[54] UTILITY TORCH HAVING HEAD MIXER

[75] Inventor: Roger D. Zwicker, Arlington, Tex.

[73] Assignee: Victor Equipment Company, Denton, Tex.

[21] Appl. No.: 373,043

[22] Filed: Apr. 29, 1982

[51] Int. Cl.[3] ..... B01F 5/00

[52] U.S. Cl. ..... 48/180 F; 48/192; 239/424.5; 239/427.5; 431/346

[58] Field of Search ..... 48/180 F, 192; 239/424.5, 427.5; 431/346; 266/48

[56] References Cited

U.S. PATENT DOCUMENTS

| | | | |
|---|---|---|---|
| 1,262,351 | 4/1918 | Jones et al. . | |
| 1,276,893 | 8/1918 | Fischer . | |
| 1,340,902 | 5/1920 | Lundgaard | 431/346 |
| 2,198,342 | 4/1940 | Jacobsson et al. . | |
| 2,263,655 | 11/1941 | Stettner . | |
| 2,371,970 | 3/1945 | Marra . | |
| 2,520,001 | 8/1950 | Eicher . | |
| 3,091,281 | 5/1963 | Clark . | |
| 4,022,441 | 5/1977 | Turney . | |
| 4,248,384 | 2/1981 | Zwicker . | |

*Primary Examiner*—Peter F. Kratz

*Attorney, Agent, or Firm*—Wofford, Fails & Zobal

[57] ABSTRACT

An improvement in a cutting torch assembly that obviates the tendency to have flashback and sustained burning with certain fuels, including cutting oxygen valve and passageway, preheat oxygen valve and passageway, fuel gas valve and passageway, a head having a tip end for having a tip affixed thereto and having a head passageway for cutting oxygen and a head passageway for mixture of fuel and oxygen, the improvement being characterized by an integral head mixer having within the head an incoming preheat oxygen passageway and incoming fuel passageway, a mixer insert disposed within the incoming fuel passageway and having engaging seal means for constraining the fuel to flow through the insert, the insert having a centrally disposed bore communicating at its inlet end with the incoming fuel passageway and terminating in a plurality of at least three apertured passageways that flow the fuel into intimate admixture with the preheat oxygen in the annular space thereabout. Also described are specific preferred embodiments including particular critical ratios of areas for mixing, numbered passageways and the like to achieve the necessary admixing.

6 Claims, 9 Drawing Figures

UTILITY TORCH HAVING HEAD MIXER

FIELD OF THE INVENTION

This invention relates to torches. More particularly, it relates to cutting torches, either the straight cutting type or the attachment type, having a plurality of passageways for the cutting oxygen and the oxygen-fuel mixture. In a particular aspect it relates to an improvement in cutting torches employing integral head mixers.

DESCRIPTION OF THE PRIOR ART

The advent of welding solved many problems that had plagued manufacturers earlier. The use of torches, such as cutting torches, welding torches, heating torches and the like also helped the repairmen to perform a variety of repairs at a site instead of having to return an article to the factory to be repaired. There have been employed in the prior art a wide variety of types of torches. One of the types is known as the injector type mixer in which one of the gases being flowed down a pre-heat tube is emitted in a high speed stream to aspirate the other gas into admixture therewith for heating before cutting oxygen is used. In theory, the injector type mixers have offered more flexibility than other type mixers. In actual use, however, injector type mixers have been relatively expensive, had a tendency to have sustained burning on flashback, burn up the torch when used with certain fuel gases such as acetylene and the like. Injector designers in the past have worked to try to simplify the manufacture of the torches while alleviating difficulties with the prior art element such as flashback.

One of the ways in which the prior art designers have attempted to eliminate flashback was the use of exceptionally small diameter passageways and employing a plurality of the passageways to supply, for example, oxygen and fuel gas.

There are a wide variety of prior art torches illustrated in the United States Patents. These includes patents such as U.S. Pat. No. 2,198,342, although there are other patents extending back to U.S. Pat. No. 1,262,351, as early as April, 1918, that show the use of mixing spirals. U.S. Pat. No. 1,276,893 shows intricate passageways to prevent backfiring of a torch. U.S. Pat. No. 2,263,655 shows a pipe coupling having a spiral fin. In U.S. Pat. No. 2,198,342, the use of a mixer and an aspirating jet of oxygen was shown. Experience with that torch indicated, however, that sustained burning could be experienced on flashback unless the respective mixers and mixer orfices were changed out with the different fuel gases. The use of a multiplicity of small diameter apertures has resulted in very expensive manufacture of the torches where they have been drilled from multiple directions in the head. Moreover, the use of a plurality of tubes welded to a common head with an integral mixer passageway was relatively infeasible and expensive because of the plurality of passageways that had to be drilled to conduct the oxygen to admix with the fuel in order to eliminate flashback. In my U.S. Pat. No. 4,248,384 I described these difficulties and a solution employing different diameter drilled passageways in the head. Cited against that patent was the following U.S. Pat. Nos. 2,371,970 and 2,520,001 showed other types of cutting torches employing tip mixers. Also, U.S. Pat. No. 3,091,281 described a torch having a tip mixer. U.S. Pat. No. 4,022,441 is a patent by co-inventor Larry Turner, assigned to the same assignee as this application and describes the use of a copper spiral for dissipating heat and alleviating problems of flashback.

Despite the improved operability of my improvement described in the aforementioned U.S. Pat. No. 4,248,384, it was still deemed possible to make further, unobvious, economical changes and invention to improve the cost of production in a torch having an integral head mixer.

Thus, it can be seen that the prior art did not provide the most simple, economical, readily manufactured head with integral head mixer in a cutting torch to alleviate the difficulties of the prior art, such as sustained burning on flashback and the like.

SUMMARY OF THE INVENTION

Accordingly, it is an object of this invention to provide a torch that obviates the tendencies to have sustained burning on flashback and the disadvantages of the prior art, yet is economical, and easily manufactured without requiring the multiplicity of small diameter holes to be drilled, yet still achieve the versatility of the torches having integral head mixers.

It is a specific object of this invention to provide a cutting torch that has the versatility of the mixer torches with the mixers in the head, that can be operated on any gaseous welding fuel, even at low pressure, yet alleviate the difficulties with the prior art and provide an integral head type mixer with all of the advantages of the prior art.

These and other objects will become more clearly apparent from the descriptive matter hereinafter, particularly when taken in conjunction with the appended drawings.

In accordance with this invention there is provided a torch, such as a cutting torch, that obviates the tendency to have flashback and sustained burning with certain fuels, such as acetylene, yet still achieve the flexibility theoretically inherent in integral head mixer torches. The straight cutting torch or torch and handle combined includes a cutting oxygen valve and passageway, a preheat oxygen valve and passageway, a fuel gas valve and passageway, a head having a tip end for having a tip affixed thereto and having a head passageway for cutting oxygen and head passageway for a mixture of fuel and oxygen and has the following improvements. The improvement comprises an integral head mixer having within the head an incoming preheat oxygen passageway and an incoming fuel passageway, a mixer insert disposed within the incoming fuel passageway and having engaging seal means for constraining the fuel to flow through the insert; the insert having a centrally disposed bore communicating at its inlet end with the incoming fuel passageway and terminating at its discharge end in a plurality of at least three apertured passageways that extend radially outwardly at respective acute angles with respect to the longitudinal axis of the bore and pointed downstream. The apertured passageways terminate downstream of the seal means so as to direct the fuel into a surrounding annular space having oxygen flowed therethrough. The surrounding annular space has an annular area between the insert and the wall of the head passageway for the mixture that is about the same as the total area of the apertured passageways whereby the fuel is intimately admixed with the preheat oxygen in the short interval within the head, obviating disastrous and damaging flashback. In preferred embodiments, the insert has first and second bores that are substantially aligned, the first bore having a first diameter and containing a heat dissipating spiral, the second bore having a second diameter smaller than the first diameter and extending physically outwardly from the seal means to the apertured passageways. Seal means comprises co-engaging shoulder and recess on the insert and the incoming fuel passageway. Preferably there are four apertured passageways and the ratio of the area of the annular space thereabout to the ratio of the total area of the apertured passageways is in the range of 1:1 to 1.2:1; preferably, about 1.1:1.

DESCRIPTION OF THE PREFERRED EMBODIMENTS

Figure 1:
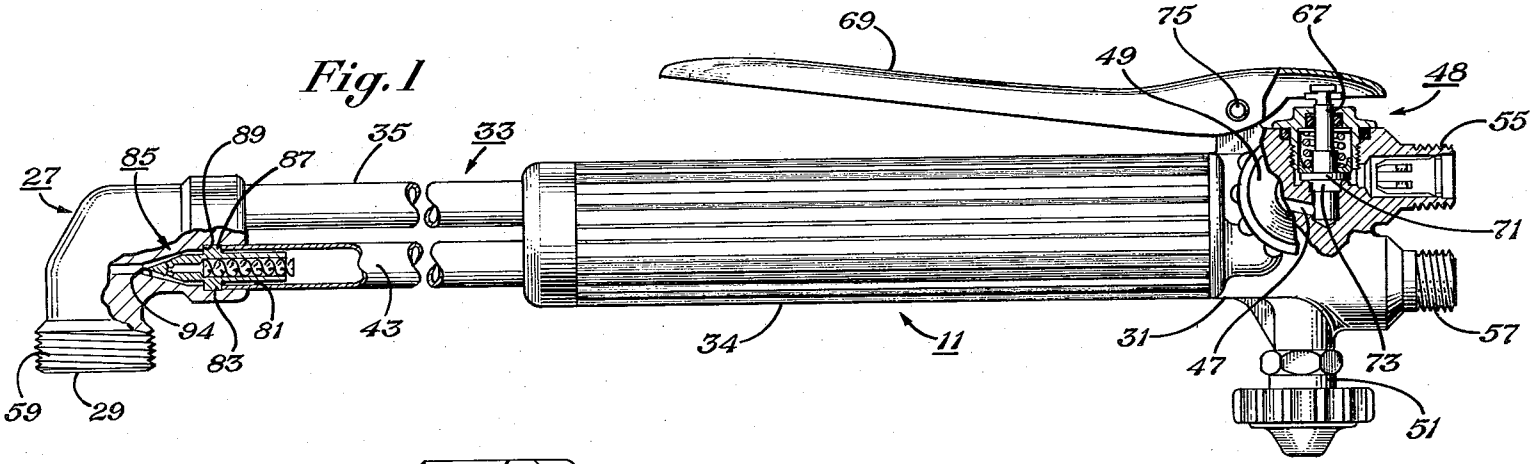
FIG. 1 is a side elevational view, partly in section and partly cut away showing a cutting type torch in accordance with one embodiment of this invention.
Figure 2:
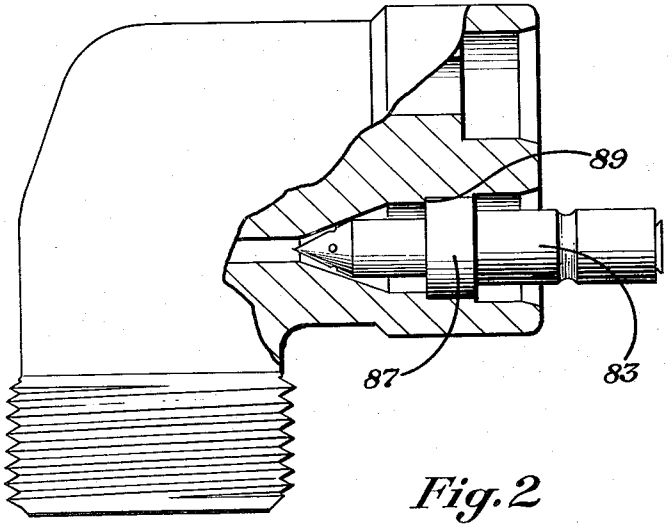
FIG. 2 is a partial side elevational view, partly cut away showing the integral head mixer in accordance with the embodiment of FIG. 1.

Referring to FIG. 1, there is illustrated a cutting type torch 11, such as is employed by a welder. The cutting torch 11 includes a torch head 27 having a tip end 29, a body 31 and respective interconnecting tubes 33 surrounded by a barrel 34. As is recognized and specifically described in U.S. Pat. No. 4,248,384, the contents of which are incorporated herein by reference for details that are omitted herefrom, there are three tubes 33 that are integrally connected as by welding, silver soldering or the like, with the head 27. The three tubes comprise a cutting oxygen tube 35, FIGS. 1 and 7, having a cutting oxygen passageway 37 penetrating longitudinally thereof; a preheat oxygen tube 39 having a preheat oxygen passageway 41 penetrating longitudinally thereof; and a fuel tube 43 having a fuel gas passageway 45 penetrating longitudinally thereof. Each of the tubes are also integrally affixed as by way of welding, silver soldering or the like, to the body 31 so as to connect with respective cutting oxygen passageway 47 having a cutting oxygen valve 48, preheat oxygen passageway communicating with the preheat oxygen valve 49 and the fuel passageway communicating with the fuel valve 51.

The torch head is a so-called ninety degree (90°) torch head, such as employed by a welder to orient the torch tip at substantially ninety degrees (90°) to the remainder of the torch to facilitate observation of the work being performed. If desired, the head may be of any other orientation such as a straight head, as employed in machine welding operations or the like. As illustrated, the torch head 27 has a threaded section 59 adjacent its tip end 29 for attaching a tip thereto, the threaded section being covered by a thread protector in the usual course of events before the tip is connected thereto.

Figure 7:
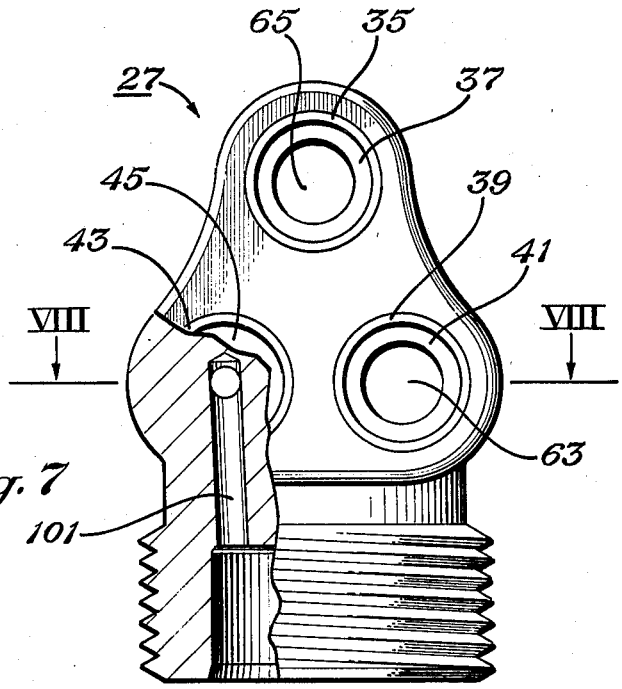
FIG. 7 is an end view from the tube end of the head of FIG. 1 showing the respective passageways and partially cut away to show the passageway to the tip for the mixture of fuel and oxygen.
Figure 8:
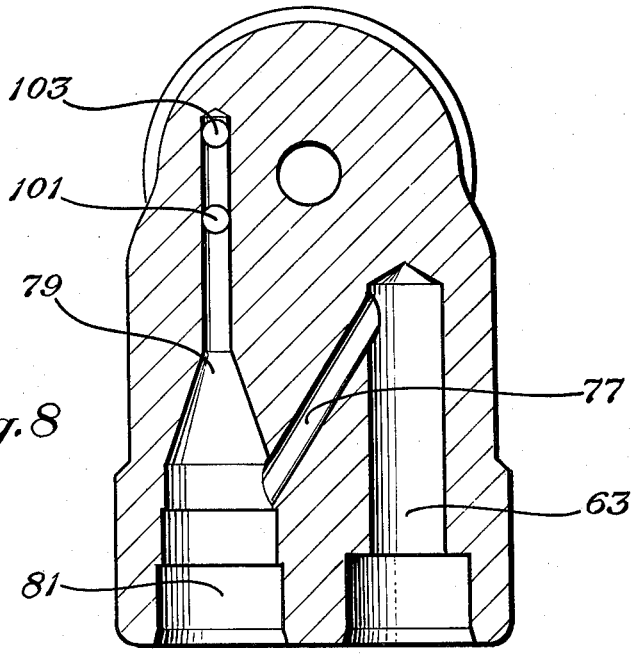
FIG. 8 is a partial cross sectional view taken along the lines VIII—VIII of FIG. 7.

The torch 27 contains a preheat passageway 63, FIG. 7, and a cutting oxygen passageway 65. The cutting oxygen passageway 65 terminates centrally of the torch head portion where the tip will be affixed at the tip end 29 as illustrated in U.S. Pat. No. 4,248,384. The preheat oxygen passageway 63 terminates eccentrically thereof and is drilled back as shown in FIG. 8 to form a concentric bore that will form a concentric annular mixing chamber for fuel and oxygen. The passageway mixes the fuel and oxygen in conjunction with a torch tip that is affixed at the tip end 29. As is recognized, the torch tip that will be affixed has a centrally disposed passageway for cutting oxygen and a plurality of passageways disposed concentrically thereabout for the mixture of fuel and oxygen. Any of the conventional torch tips may be employed, since they have a shoulder that sealingly abuts the mating portion of the torch head such that the cutting oxygen passageway is isolated from the fuel and oxygen chamber and passageways, as illustrated in U.S. Pat. No. 4,022,441 "Universal Torch", inventor Larry R. Turney, assigned to Victor Equipment Company or U.S. Pat. No. 4,030,710 "Floating Tube Torch", inventor Larry R. Turney, assigned to Victor Equipment Company; the contents of both of which are incorporated herein by reference.

Typically, the torch tip and the torch head will be formed of corrosion resistant metallic alloy, such as copper alloy, stainless steel, or the like.

The torch tubes 33 have substantially similar structure and are sealingly affixed so as to define sealed passageways for, respectively, the cutting oxygen, the preheat oxygen, and the fuel, all upstream of the head 27. The tubes may be formed of any of the conventional materials, such as metal tubes, as bronze, stainless steel and the like.

The body 31 is ordinarily formed of metallic alloy, such as a copper alloy, so as resist corrosion, yet sustain the relatively rough treatment that is frequently accorded it by welders, workmen and the like. As illustrated, the body 31 has respectively recesses receiving the respective valves 48, 49 and 51.

The respective oxygen flow control valve and the cutting oxygen valve are conventional and are described in other patents such as U.S. Pat. No. 3,873,038, "Precision Torch Assembly", inventor Richard W. Miller, assigned to Victor Equipment Company, the contents of which are incorporated herein by reference.

As is recognized, the upstream fittings 55, 57 are sealingly connected with respective hose connectors and hoses from high pressure regulators connected to respective pressurized containers of high pressure oxygen and high pressure fuel gas, such as acetylene or the like.

The cutting oxygen flow control valve 48 may comprise any of the conventional cutting oxygen flow control valves that are employed. The cutting oxygen flow control valves have changed little over the years and a satisfactory cutting oxygen flow control valve 48 is illustrated in U.S. Pat. No. 2,198,342. Basically, the illustrated cutting oxygen flow control valve 48 comprises a poppet member 67 that is connected with a lever 69 such that the resilient portion 71 is moved from the seat 73 to allow oxygen to flow through the valve when the lever 69 is depressed about the fulcrum point 75. The lever 69 on the cutting oxygen flow control valve 48 may be pivotally mounted such to be operable by the thumb or hand of the welder as illustrated, or it may be positioned so as to be operable by finger or the like as illustrated in U.S. Pat. No. 4,248,384; as long as it operates the poppet interiorly of the valve to control the flow of oxygen. The arrangement is frequently altered in the same line of torches.

Figure 5:
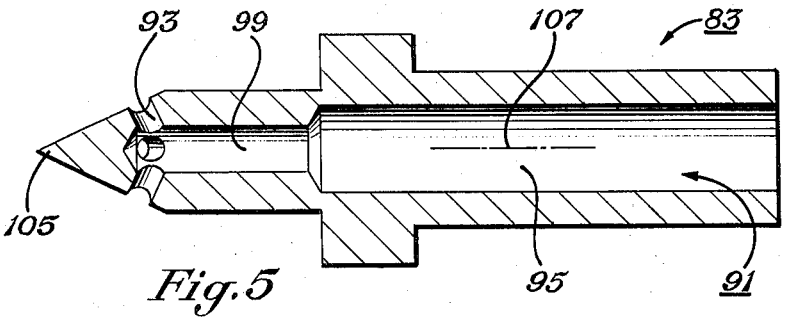
FIG. 5 shows a cross sectional view of the mixer insert of FIG. 4.
Figure 4:
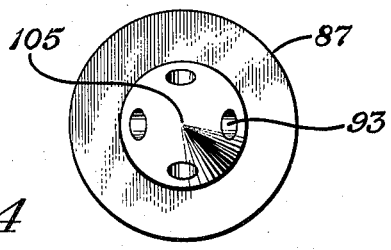
FIG. 4 shows an end view of the mixer insert.

As implied hereinbefore, prior art preheat tube assemblies included diffuser sections and the like within the torch such that mixing occurred upstream of the head 27. In this invention, however, the fuel and mixing oxygen, or preheat oxygen, have separate passageways such that there is no mixing until the head 27. Specifically, preheat oxygen passageway 41 communicates, as by passageway 77, FIG. 8, with the passageway 79 for the mixture of fuel and oxygen. The incoming fuel tube 43 with its internal passageway 45 for the fuel is connected with the head and in fluid communication with an incoming fuel passageway 81 in the head 27, FIG. 1. The incoming fuel passageway 81 has a mixer insert 83 disposed within it, and has an engaging seal means 85 for constraining the fuel to flow through the mixer insert 83. As illustrated, the seal means comprises coengaging shoulder and recess. More specifically, the shoulder 87 on the mixer insert 83 engages the recess 89 to prevent the preheat oxygen from flowing back up into the incoming fuel passageway. As can be seen, the tube 43 effectively holds the mixer insert 83 in place against the wall of the recess 89. The mixer insert 83, FIGS. 4–6, has a centrally disposed bore 91 communicating at its inlet end with the incoming fuel passageway and terminating at its discharging end in a plurality of at least three respective apertured passageways 93. The apertured passageways 93 extend radially outward at respective acute angles with respect to the longitudinal axis of the bore and project downwardly in operation so as to effect intimate admixing of the fuel and the preheat oxygen. The apertured passageways 93 terminate downstream of the seal means so as to direct the fuel into a surrounding annular space 92, FIG. **3*b*, having the preheat oxygen flowing therethrough to effect the intimate admixing therebetween. The surrounding annular space 92 has an annular area between the mixer insert 83 and the wall 94** of the head passageway for the mixture that is about the same as the total area of the apertured passageways. Preferably, the ratio of the area of the annular passageway to the area of the apertured passageways are in the ratio of about 1:1 to 1.2:1; preferably about 1.1:1. Preferably, also, there are at least four apertured passageways. It has been found that two are not satisfactory to effect the intimate admixing in the short distance within the head.

Figure 6:
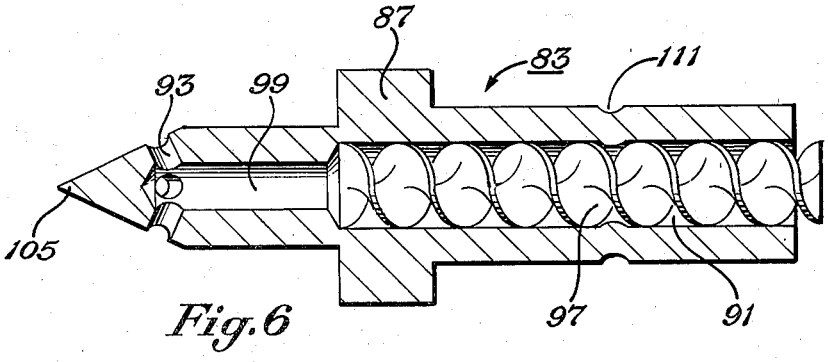
FIG. 6 shows a cross sectional view of the mixer insert of FIG. 4 with a heat dissipating spiral in a first central bore and having a crimp for being installed.

As illustrated, the central bore 91 comprises a first bore 95 of a first diameter and housing a heat dissipating spiral 97, FIG. 6. The central bore 91 comprises a second bore 99 that is substantially aligned with the first bore 95 and has a second diameter smaller than the first diameter. The second bore 99 extends physically outwardly from the seal means to the apertured passageways 93.

The passageway 79, FIG. 8, for the mixture of fuel and oxygen has a frusto-conical section terminating in a smaller passageways 101, 103 that take the mixture of fuel and oxygen into the annular mixing zone in the tip, once the torch tip is installed on the head 27.

Figure 3A:
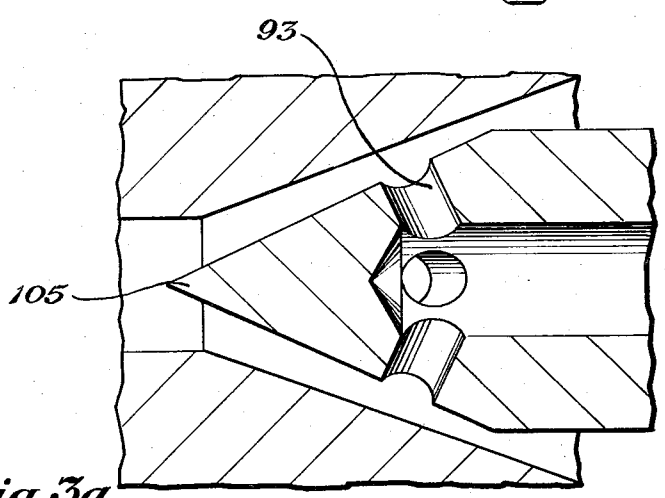
FIG. 3*a* is a partial side elevational view, partly schematic, showing the area of the annular space about the mixer insert.
Figure 3B:
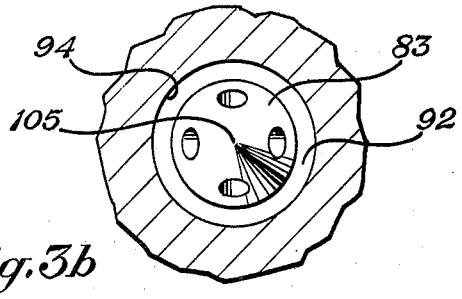
FIG. 3*b* shows an end view of the mixer of FIG. 3*a* and the annular space thereabout.

In the illustrated example, the tip 105, FIGS. **3*b*–6, of the insert 83 is conical in shape with the angle of the apex about fifty degrees (50°). The apertured passageways, of which there are four spaced at ninety degree (90°) intervals are about 0.04 inch in diameter and make an angle of about sixty-five degrees (65°) with respect to the central longitudinal axis 107, FIG. 5. The area of the annular space between the tip 105 and the walls 94, FIGS. 1 and 3*b***, is in the range of 0.0023 square inch to 0.00851 square inch.

The mixer insert 83 has a crimp 111 for holding the copper spiral in place. If desired, the tip 105 can be truncated without adversely affecting the performance and intimate admixing of the fuel and preheat oxygen.

Preferably the respective parts illustrated and described hereinbefore are formed of corrosion resistant materials such as the copper alloy to resist corrosion and have a high heat conductivity.

In operation the torch 11 is assembled as illustrated and described hereinbefore and connected by respective appropriate hoses at respective oxygen and fuel inlet passageways 55, 57 and valves with respective oxygen and fuel sources. The desired heating flame is provided at the tip that has been inserted at the tip end 29. The flame is provided by adjusting the fuel and oxygen flow control valves. The workpiece is then heated until molten metal is achieved. At this time, the lever 69 may be depressed to open the cutting oxygen flow control valve and start the cutting operation. The cutting oxygen further effects burning and melting of the metal and flowing of the molten metal from the cuts being made. The desired operation is completed. The cutting oxygen flow control valve is turned off. Thereafter, the oxygen and flow control valves are turned off until it is desired to employ the torch again. While manually operated cutting torches are the generic form of this invention that have been described herein, cutting torch attachments having a fuel valve on a separate handle may be employed as described in U.S. Pat. No. 4,248,384. Moreover, large scale heating tips can be employed for large heating jobs as are sometimes done with any cutting and torch assembly. Also, the automated machine torches or the like may advantageously employ this invention.

The specific advantages of this invention are that the economically formed mixer formed insert in conjunction with the specifically delineated design of the passageway for the mixture of fuel and oxygen are more economical than the priorly drilled torch heads, yet still allow providing an economical torch that can alleviate disadvantages of the prior art while still achieving all the advantages of head mixer torches with very little danger of flashback or sustained burning and can be used with a variety of fuels.

Thus it can be seen that this invention achieves the objects delineated hereinbefore.

Although this invention has been described with a certain degree of particularity, it is understood that the present disclosure is made only by way of example and that numerous changes in the details of construction and the combination and arrangement of parts may be resorted to without departing from the spirit and the scope of the invention, reference being had for the latter purpose to the appended claims.

What is claimed is:

1. In a torch assembly that includes:

a. a cutting oxygen valve and passageway;

b. a preheat oxygen valve and passageway;

c. a fuel gas valve and passageway; and d. a head having a tip end for having a tip affixed thereto and having a head passageway for cutting oxygen and a head passageway for mixture of fuel and oxygen;

the improvement comprising:

e. an integral head mixer having within the head an incoming preheat oxygen passageway and an incoming fuel passageway, a mixer insert disposed within said incoming fuel passageway and having engaging seal means for constraining said fuel to flow through said insert; said insert having a centrally disposed bore communicating at its inlet end with said incoming fuel passageway and terminating at its discharge end in a plurality of at least three apertured passageways that extend radially outwardly at respective acute angles with respectively longitudinal axis of the bore; said apertured passageways terminating downstream of the seal means so as to direct the fuel gas into a surrounding annular space defined by the insert discharge end and the surrounding incoming fuel passageway, and with a connecting conduit between said preheat oxygen passageway and said incoming fuel passageway annular space for having oxygen flowed therethrough for intimate admixing between the fuel and oxygen; said surrounding annular space having an annular area between said insert and the wall of said head passageway through said mixture at the plane of the apertured passageways that is about the same as the total area of the apertured passageways;

whereby said fuel is intimately admixed with said preheat oxygen in a short interval within said head, obviating disastrous and damaging flashbacks.

2. The torch assembly of claim 1 wherein said insert has respective first and second centrally disposed bores that are substantially aligned, said first bore having a first diameter and containing a heat dissipating spiral, said second bore having a second diameter smaller than said first diameter and extending physically outwardly from said seal means to said apertured passageways.

3. The torch assembly of claim 1 wherein said seal means comprises co-engaging shoulders and recesses on said insert and said incoming fuel passageway.

4. The torch assembly of claim 1 wherein there are at least four apertured passageways to provide the intimate admixing of said preheat oxygen.

5. The torch assembly of claim 1 wherein the ratio of the area of the annular space about the apertured passageway's discharge end compared to the area of all of the apertured passageways is in the ratio of 1:1 to 1.2:1.

6. The torch assembly of claim 5 wherein the ratio is about 1.1:1.

* * * * *